US006776885B2

(12) United States Patent
Economikos et al.

(10) Patent No.: US 6,776,885 B2
(45) Date of Patent: Aug. 17, 2004

(54) INTEGRATED PLATING AND PLANARIZATION APPARATUS HAVING A VARIABLE-DIAMETER COUNTERELECTRODE

(75) Inventors: Laertis Economikos, Wappingers Falls, NY (US); Hariklia Deligianni, Tenafly, NJ (US); John M. Cotte, New Fairfield, CT (US); Panayotis C. Andricacos, Croton-on-Hudson, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/294,199

(22) Filed: Nov. 14, 2002

(65) Prior Publication Data

US 2004/0094403 A1 May 20, 2004

(51) Int. Cl.[7] ..... C25D 14/00

(52) U.S. Cl. ..... 204/224 R; 204/224 M; 204/212; 204/222; 205/133; 205/143; 205/96

(58) Field of Search ..... 204/212, 222, 204/224 M, 224 R; 205/133, 143, 96

(56) References Cited

U.S. PATENT DOCUMENTS

| | | | | |
|---|---|---|---|---|
| 5,421,987 A | * | 6/1995 | Tzanavaras et al. | 205/133 |
| 5,911,619 A | | 6/1999 | Uzoh et al. | |
| 6,004,880 A | | 12/1999 | Liu et al. | |
| 6,270,646 B1 | | 8/2001 | Walton et al. | |
| 6,328,872 B1 | | 12/2001 | Talieh et al. | |
| 6,497,801 B1 | * | 12/2002 | Woodruff et al. | 204/230.2 |
| 2002/0000383 A1 | * | 1/2002 | Lee | 205/122 |
| 2002/0020627 A1 | * | 2/2002 | Kunisawa et al. | 205/96 |
| 2003/0038035 A1 | * | 2/2003 | Wilson et al. | 205/96 |

* cited by examiner

*Primary Examiner*—Wesley A. Nicolas
(74) *Attorney, Agent, or Firm*—Jay H. Anderson

(57) ABSTRACT

An apparatus for plating and planarizing metal on a substrate includes a plurality of dispensing segments, each having at least one hole for dispensing electroplating solution onto the substrate. The dispensing segments form a circular counterelectrode and are movable with respect to each other during an electroplating process, so that the counterelectrode has a variable diameter. The electroplating solution is thus dispensed on an annular portion of the substrate having a diameter corresponding to the diameter of the counterelectrode; accordingly, the variable-diameter counterelectrode permits localized delivery of the plating solution to the substrate.

12 Claims, 8 Drawing Sheets

INTEGRATED PLATING AND PLANARIZATION APPARATUS HAVING A VARIABLE-DIAMETER COUNTERELECTRODE

FIELD OF THE INVENTION

This invention relates to semiconductor processing, and more particularly to an apparatus for plating and planarization of material on a semiconductor wafer.

BACKGROUND OF THE INVENTION

In the fabrication of semiconductor devices, deposition and selective removal of metallic layers are important processes. A typical semiconductor wafer has several layers of metal deposited or plated on its surface, with each successive layer being polished or etched before further layers are added. In particular, electroplating of copper on the wafer surface is a widely practiced process. Plating of copper (which generally produces a blanket layer of copper on the wafer) is typically followed by electroetching or chemical-mechanical polishing (CMP) to remove unwanted portions of the plated layer.

In a typical Cu plating process on a semiconductor wafer, the wafer surface is first coated with a barrier/liner layer to promote adhesion of the plated metal layer to the wafer and to prevent diffusion of the Cu into the semiconductor material. A seed layer is then deposited on the liner. The electroplated Cu coats the wafer surface and fills features (e.g. trenches) formed in the surface. The plated layer must be thick enough ensure that the trench is filled. The excess thickness, termed "overburden," is then removed by electroetching or CMP. Often the entire plated layer above the wafer surface is removed so that copper metal remains only inside the trench; this may be done by polishing the wafer in a CMP apparatus until the original front surface of the wafer is exposed.

Plating and planarization of the metal layer are conventionally done in separate tools. As noted above, processing of a typical wafer requires several different plating steps, with each followed by a planarization step. A typical wafer therefore is processed multiple times in both the plating and planarization tools. This situation tends to limit the throughput of the manufacturing process, and accordingly increases the overall manufacturing cost.

U.S. Pat. No. 6,004,880, titled "Method of single step damascene process for deposition and global planarization," suggests adapting a CMP apparatus to perform plating and polishing simultaneously. However, plating and polishing often require different process conditions (e.g. different mechanical force on the wafer surface), which cannot be obtained in a simultaneous process. Furthermore, if a polishing slurry containing an abrasive is combined with an electrolyte plating solution, abrasive particles may be trapped in the plated metal layer.

In order to perform plating uniformly on the wafer and with minimum overburden, it is desirable that the plating solution be delivered to the wafer in precise amounts in accordance with the location on the wafer. Such localized delivery of plating solution is not available in plating tools where the entire wafer is bathed or sprayed with solution simultaneously.

In recent applications of electroplating (such as damascene plating of on-chip interconnects), the continuing trend toward smaller electronic devices has led to a tendency use thinner conductive seed layers, or to eliminate the conductive layer and plate directly on the high-resistivity liner. The high active area density in damascene plating, the trend toward larger wafers, the need for higher plating rates and stringent requirements on thickness uniformity all contribute to the problem known in the art as the "terminal effect." This effect is caused by the high ohmic potential drop within the seed layer and the plated deposit, and results in a non-uniform current distribution in the vicinity of the electrical contacts on the wafer. Within the electrolyte, in the space between the plating anode and the wafer surface being plated, the potential drop is linear; at the interface between the electrolyte and seed layer there is a sudden drop in potential, and there is a non-linear potential drop through the seed layer. The thin seed layer (or liner) often has very high resistivity, and the resistance of passing the plating current through the contact terminal is likewise very high. Accordingly, the resistance of the seed layer dominates the overall resistance of the plating circuit, and the high local current density in the vicinity of the contact terminal causes severe non-uniformity in the thickness of the plated metal. The terminal effect may result in very little metal being plated at the wafer center.

There remains a need for a wafer processing tool which integrates the features of electroplating and planarization tools, and thus can perform alternating electroplating and electroetching processes, together with CMP (particularly for copper layers), with optimized conditions for each process. There is also a need for a plating tool which permits localized delivery of plating solution to the wafer. In particular, there is a need for a plating tool which does not suffer from the terminal effect when very thin seed layers are used.

SUMMARY OF THE INVENTION

The present invention addresses the above-described need by providing an apparatus for performing electroplating of a metal layer on a substrate, where the electroplating is performed using a ring counterelectrode with a variable diameter.

The apparatus of the present invention includes a plurality of dispensing segments, each having at least one hole for dispensing an electroplating solution onto the substrate. The dispensing segments form a circular counterelectrode and are movable with respect to each other during an electroplating process, so that the anode has a variable diameter. The electroplating solution is thus dispensed on an annular portion of the substrate having a diameter corresponding to the diameter of the counterelectrode; accordingly, the variable-diameter counterelectrode permits localized delivery of the plating solution to the substrate. A carrier holds the substrate substantially parallel to the counterelectrode; the carrier rotates with respect to the counterelectrode and includes a plating cathode.

According to a first aspect of the invention, the apparatus has a plate parallel to the substrate, with each dispensing segment being attached to the plate and slidable with respect thereto along a radius of a circular anode. The dispensing segments may be electrically connected using a flexible conductor. Each dispensing segment is connected to a flexible tube for providing the electroplating solution thereto. According to another aspect of the invention, the dispensing segments are non-conductive, and an anode electrode is placed in contact with the electroplating solution.

The apparatus may perform an electroetching process as well as an electroplating process. When electroetching is performed, an electroetching solution is dispensed through the dispensing segments. Current is conducted between the cathode and the anode in a forward direction during an electroplating process and in a reverse direction during an electroetching process.

More generally, the dispensing segments of the present invention dispense a plating solution and/or an etching solution onto a substrate; the dispensing segments form a circular array and are movable with respect to each other during a plating or etching process so that the array has a variable diameter.

According to another aspect of the invention, each of the dispensing segments of the anode has a tapered profile in a direction along the circumference of the circular anode so that each segment has a narrow end and a wide end. The segments are arranged so that the narrow end of each segment is inserted into the wide end of the adjacent segment to form an overlap between adjacent segments; the diameter of the circular anode is varied by varying an amount of overlap of adjacent segments.

According to an additional aspect of the invention, the apparatus includes a polishing table and a polishing pad disposed thereon, for performing a planarization process on the substrate, such as CMP. The polishing table may be interposed between the substrate and the circular anode after the electroplating process is performed.

DETAILED DESCRIPTION OF THE PREFERRED EMBODIMENTS

In accordance with the present invention, an apparatus is provided which permits metal deposition (electroplating), and metal removal (electroetching) and planarization by CMP, in a single chamber and without the need for removing the wafer from the apparatus. In particular, the electroplating and electroetching is performed using a counterelectrode with a variable diameter. Plating and removal of copper will be described to illustrate the invention. It will be appreciated that the present invention is not limited as to the type of material deposited on or removed from the wafer.

Figure 1:
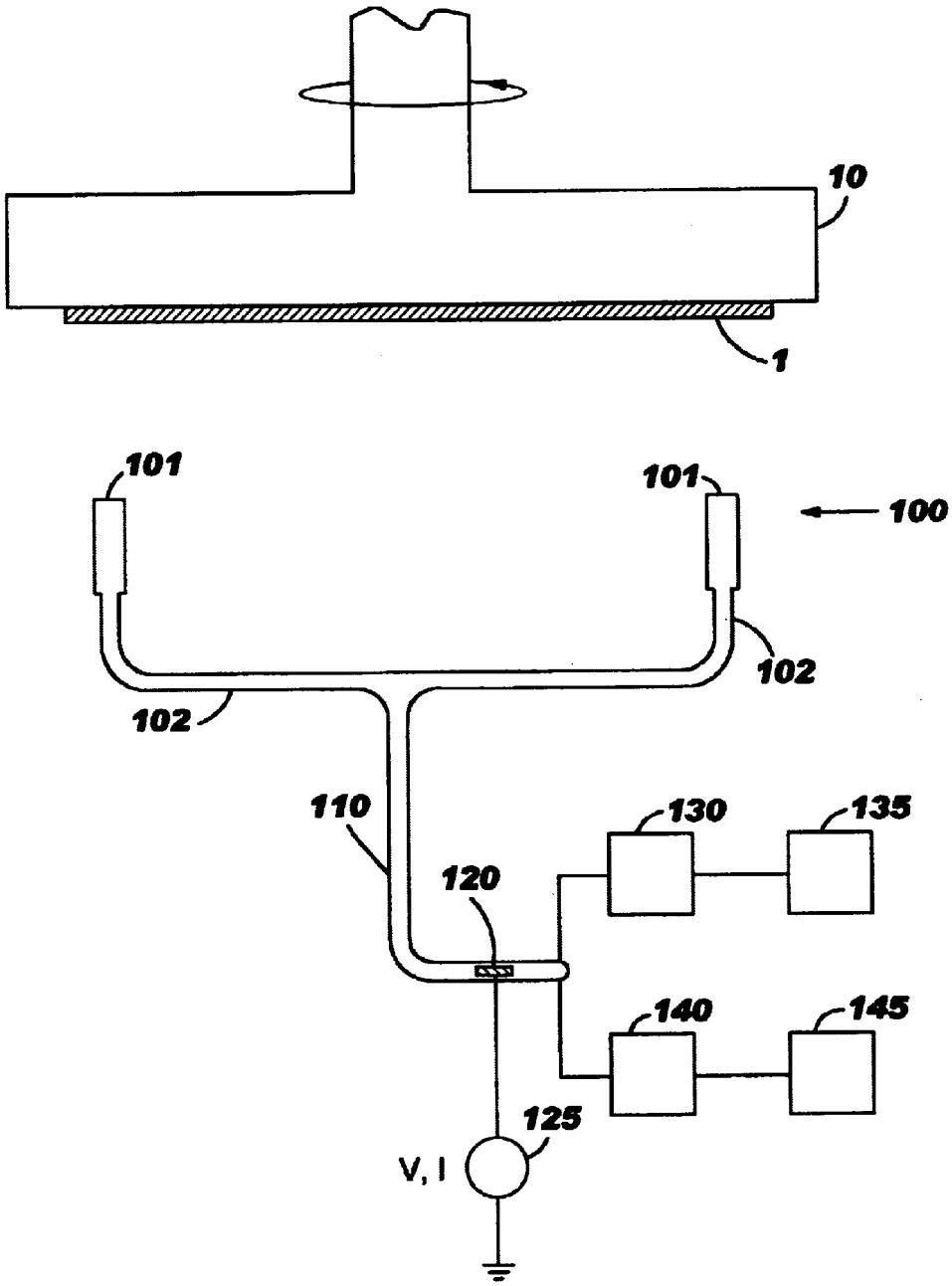
FIG. 1 is a schematic illustration of an integrated tool for plating and electroetching with movable fluid dispensers forming a variable-diameter ring anode, in accordance with an embodiment of the invention.

A general schematic view of an embodiment of the present invention is shown in FIG. 1. Wafer 1 is held upside down on a wafer carrier 10 (as in a conventional CMP apparatus), which rotates with respect to a ring-shaped anode electrode 100. In a plating process, the wafer carrier 10 functions as the cathode electrode. The anode has a number of segments 101 which dispense the plating or etching solution onto the wafer (two dispensing segments are shown in the cross-sectional view. of FIG. 1). Each dispensing segment has a tube 102 connected thereto; tubes 102 must be flexible to permit movement of the dispensers 101 with respect to the wafer, as explained in detail below. The dispensing tubes 102 are connected to a central feed tube 110 which conducts the plating or etching solution to the anode. The feed tube 110 is connected to a pump 130 which moves plating solution from a reservoir 135 during a plating process. A separate pump 140 may be used to move etching solution from a reservoir 145 during an electroetching process.

In the embodiment shown in FIG. 1, the dispensing segments 101 and the feed tubes 102, 110 are of a nonconductive material, while the plating solution is typically a conductive fluid. An anode electrode 120 is placed in contact with the fluid (immersed in or surrounding the fluid) and connected with a voltage source 125, so that the fluid is dispensed at anode potential. Alternatively, the tubes and dispensers may be of a conductive material, with the anode voltage source connected thereto.

Figure 2A:
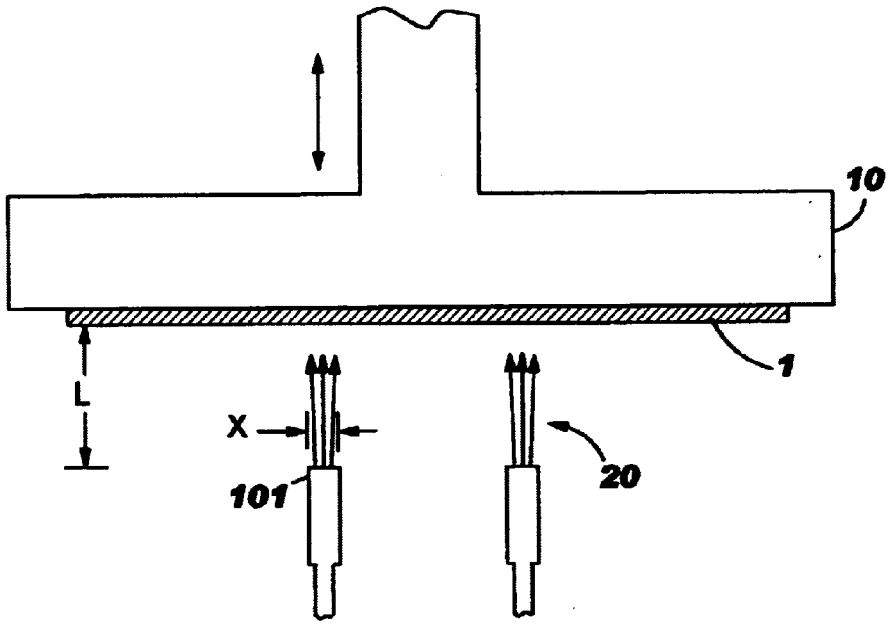
FIG. 2A is a schematic illustration of localized delivery of plating solution from the ring anode of FIG. 1, when the ring has a small diameter.
Figure 2B:
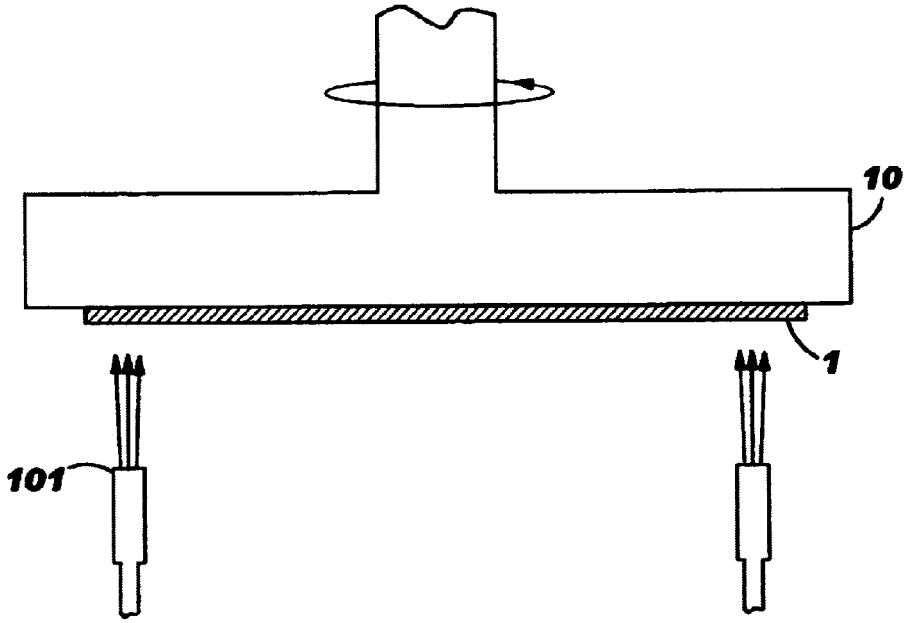
FIG. 2B is a schematic illustration of localized delivery of plating solution from the ring anode of FIG. 1, when the ring has a large diameter.

The dispensing segments 101 of the anode are arranged in a ring which mechanically expands and contracts to provide a variable-diameter ring anode, as shown in FIGS. 2A and 2B. In FIG. 2A, the ring is contracted to a small diameter. Each dispenser deposits fluid 20 over a radial distance X which is approximately the same as the radial extent of the dispenser. Although the ring has discrete dispensers, it should be noted that the carrier rotates with respect to the anode, so that each dispenser delivers fluid along an arc rather than at a single point. Accordingly, fluid 20 is dispensed onto a small annular region of the wafer; this region has a radial dimension X and a diameter corresponding to that of the ring anode. In FIG. 2B, the ring is expanded to a large diameter; fluid is dispensed onto a large-diameter annular region of the wafer. Localized delivery of the fluid 20 is thus performed as the ring diameter is varied. The wafer carrier 10 is moved up and down with respect to the anode to adjust the distance L between the dispensers and the wafer surface; in practice this distance is a few mm.

Figure 3:
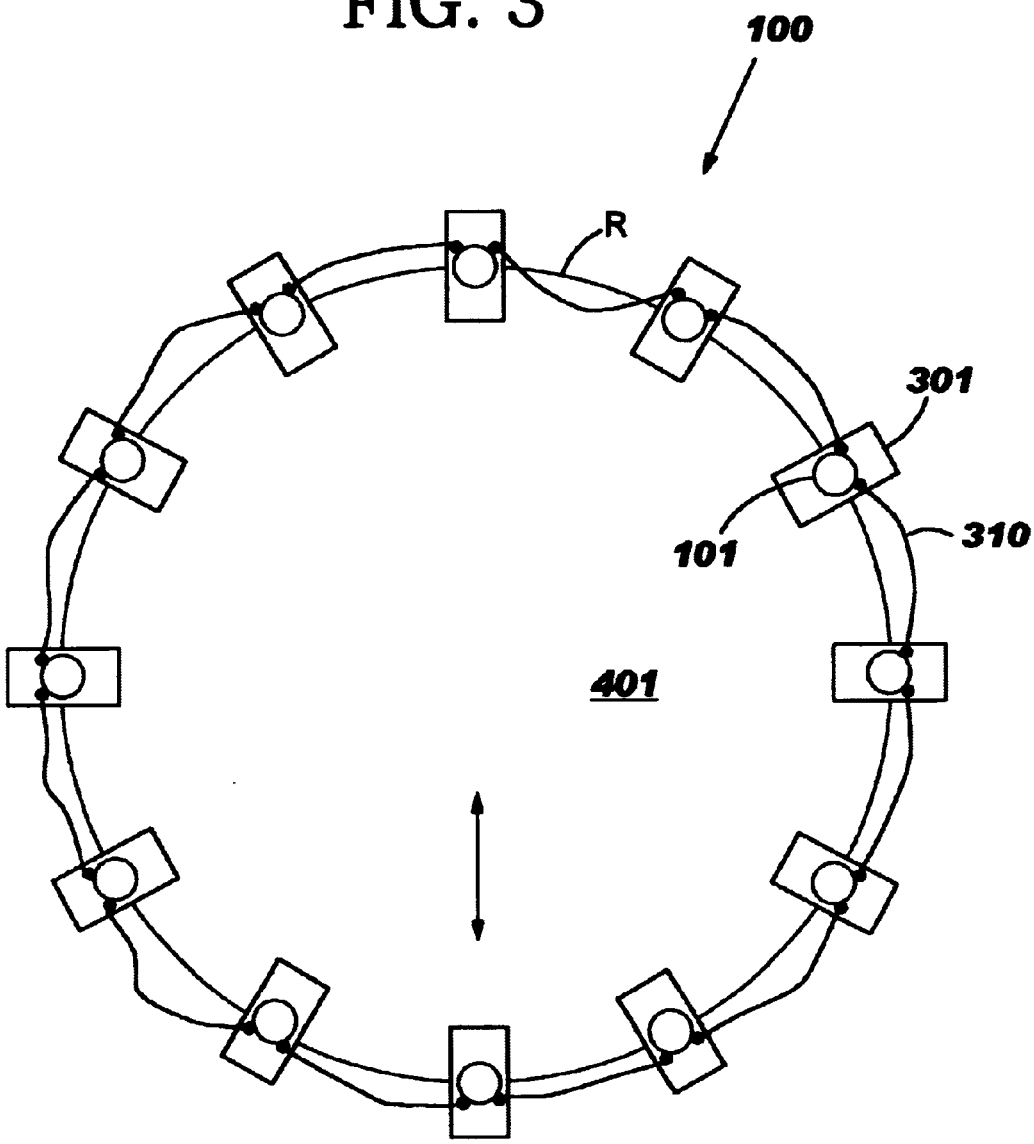
FIG. 3 is a plan view of a variable-diameter ring anode in accordance with an embodiment of the invention.
Figure 4A:
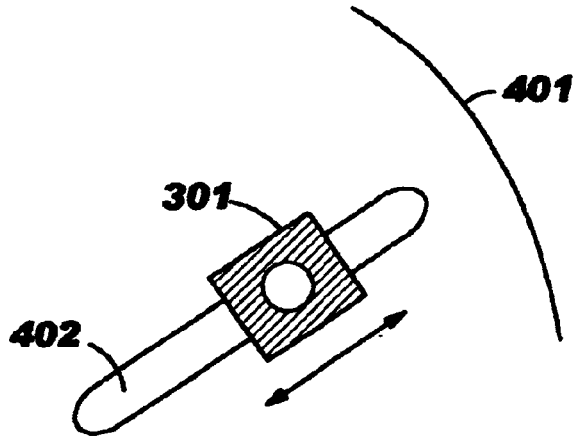
FIG. 4A is a detail plan view showing one fluid dispenser of the variable-diameter ring anode.
Figure 4B:
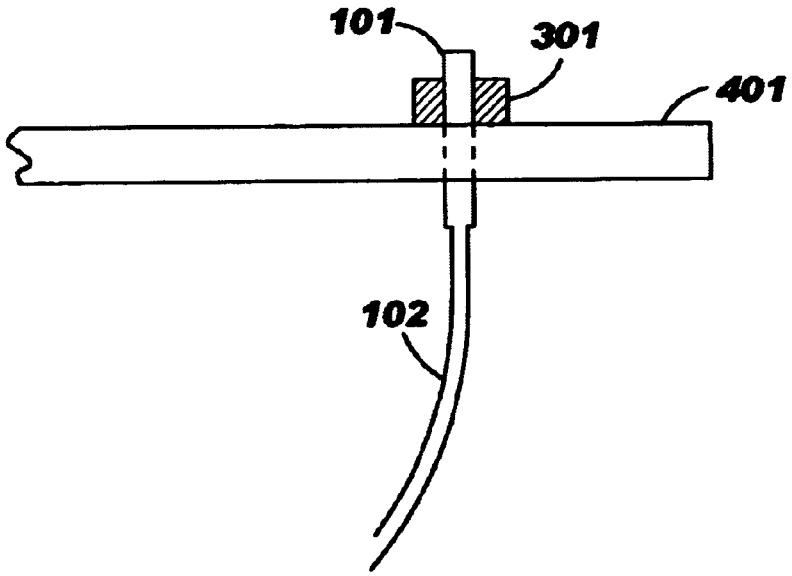
FIG. 4B is a detail cross-section view showing one fluid dispenser of the variable-diameter ring anode.

The ring anode 100, with multiple fluid dispensers 101, may be constructed as shown in FIG. 3. The dispensers are arranged in a circle of radius R. Each dispenser is disposed in a hole through a sliding piece 301 which in turn rests on a plate 401. A flexible conductor 310 may be used to electrically connect the dispensers. FIGS. 4A and 4B are detail views showing how the circular array of dispensers may be expanded and contracted. Plate 401 has a radial slot 402 for each dispenser, so that linear motion of slider 301 causes the dispenser to move radially in the slot. The diameter R of the array varies as the dispensers move radially in unison. Each slider 301 may be individually actuated; alternatively, the various sliders may be mechanically linked so that external force on only one slider is required.

In this embodiment, the ring anode 100 comprises separate dispensers 101 mechanically supported by plate 401. It is noteworthy that the anode is not a mechanically continuous ring, but instead dispenses fluid from dispensing segments arranged in a ring of variable size. In a plating process, the plating solution is continuously dispensed (typically at a rate of 100–400 mml/min) while the wafer rotates with respect to the ring anode; the supply of plating solution to the wafer is thus constantly refreshed. Since only a small annular region of the wafer is plated at any given time, process conditions may be chosen for specific portions of the wafer. For example, the anode current (and hence the metal deposition rate) may be varied as the radius of the anode ring is varied.

In addition, it is often desirable that alternating plating and etching processes are performed to limit the growth of the overburden. This may be done by electroetching of the plated metal using the same solution as in the plating process, but with a very high anodic reverse voltage pulse. The distance L between the wafer and anode may also be changed during the etching step. A repeated plating/etching sequence permits filling of recessed areas of the wafer with very little overburden.

The voltage/current source 125 may be adjusted to provide either a constant voltage or a constant current depending on whether a plating or etching process is being performed, as is known in the art.

Figure 5:
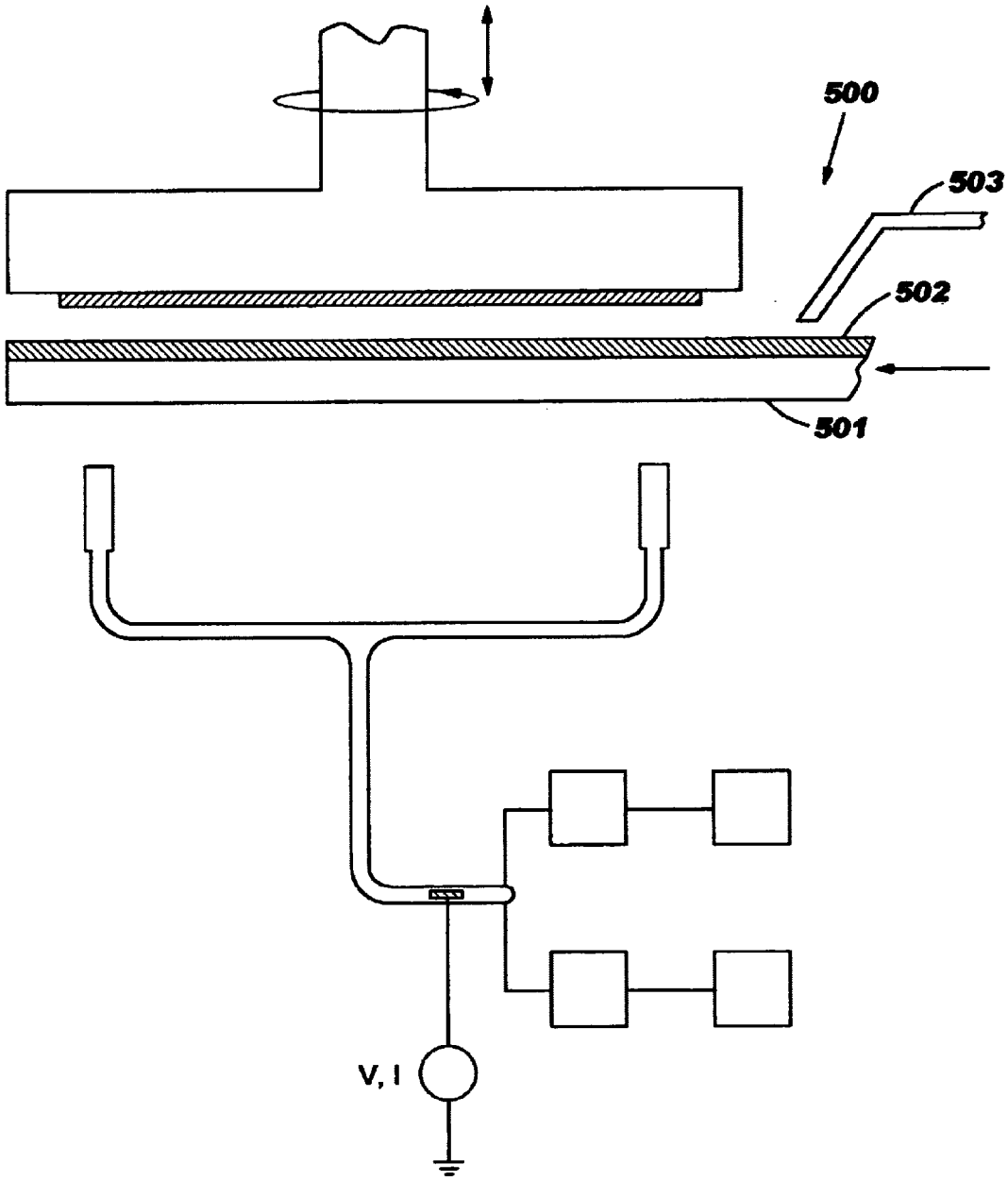
FIG. 5 is a schematic illustration of an integrated plating and planarization tool according to an additional embodiment of the invention, where the tool includes a polishing pad for performing a CMP process.

Furthermore, it is generally desirable to combine capabilities for plating, etching and CMP in a single apparatus. FIG. 5 is a schematic illustration of an embodiment of the invention where the wafer may be polished in the same chamber, after a sequence of plating and etching. In this embodiment, the wafer carrier is retracted upward and a polishing assembly 500, including table 501 and polishing pad 502 mounted on the table, is interposed between the wafer 5 carrier and the anode. The wafer is then brought into contact with the polishing pad, and polishing slurry is dispensed thereon through dispenser 503. The wafer carrier may make rotary and orbital motion with respect to the polishing pad. The slurry used in the Cu CMP process is an abrasive-free solution, so that roughening and chemical alteration of the remaining Cu surface are avoided.

Alternatively, the CMP apparatus may be provided in a separate chamber in an integrated tool. In this case the wafer carrier is moved from the plating/etching chamber, through a loadlock and into the CMP chamber when the plating/etching sequence is completed.

The apparatus may advantageously also include a pencil or brush cleaner for the wafer, so that the wafer may be cleaned and dried after polishing before it is removed from the tool.

Figure 6:
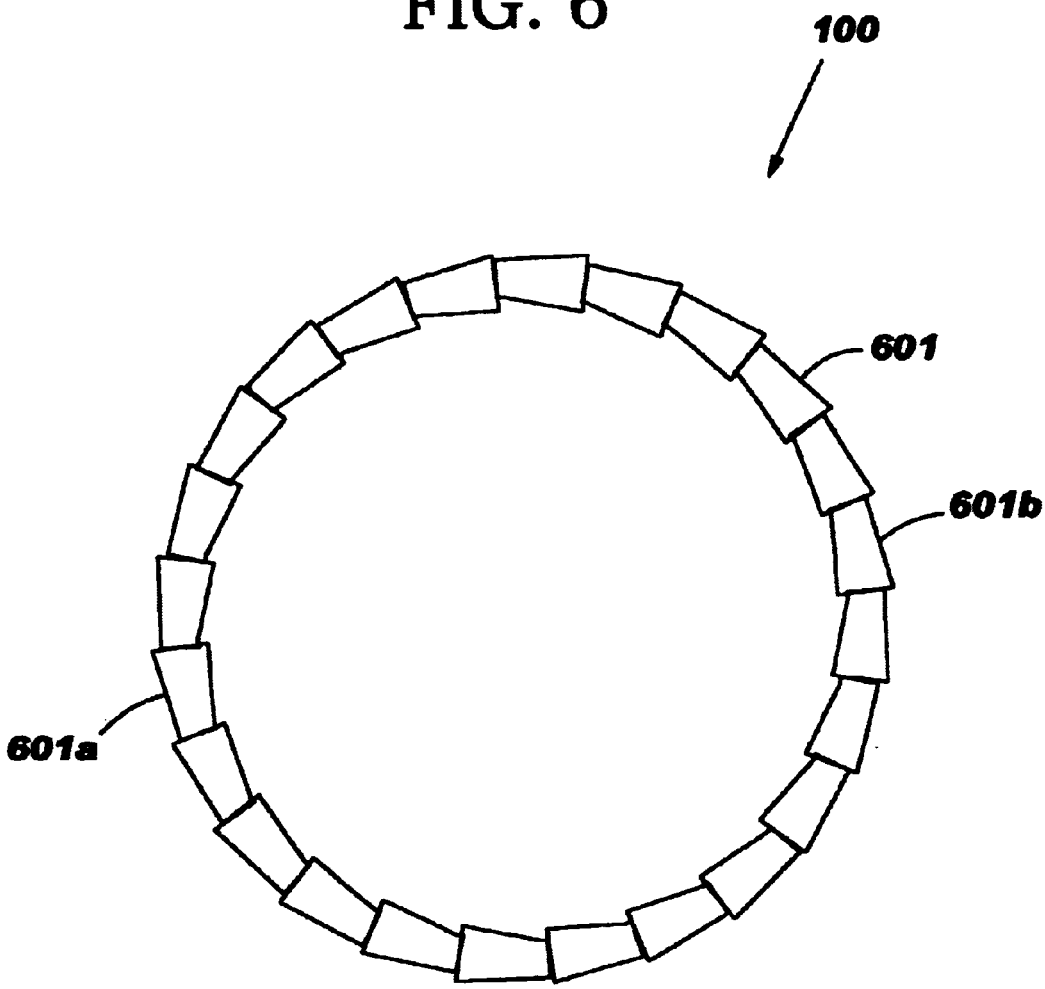
FIG. 6 is a plan view of a variable-diameter ring anode having interlocking segments, according to another embodiment of the invention.
Figure 7A:
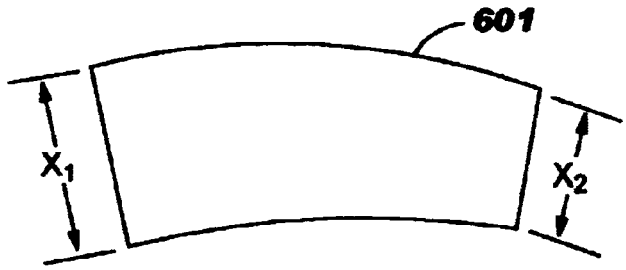
FIG. 7A is a detail plan view of a segment of the ring anode of FIG. 6.
Figure 7B:
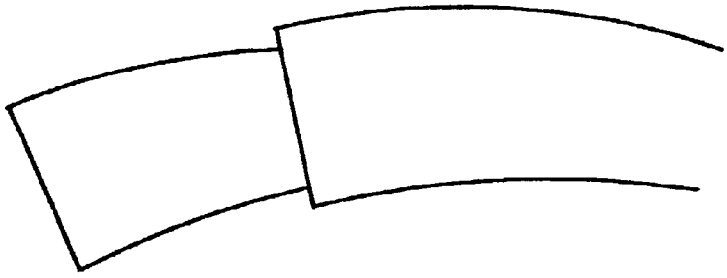
FIG. 7B is a plan view of two ring segments fitted together to form a portion of a small-diameter ring anode.
Figure 7C:
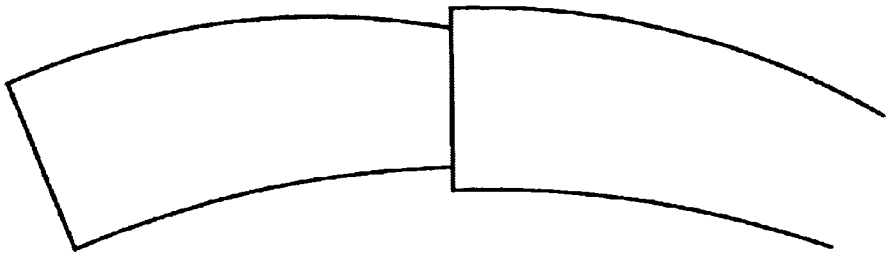
FIG. 7C is a plan view of two ring segments fitted together to form a portion of a large-diameter ring anode.
Figure 8A:
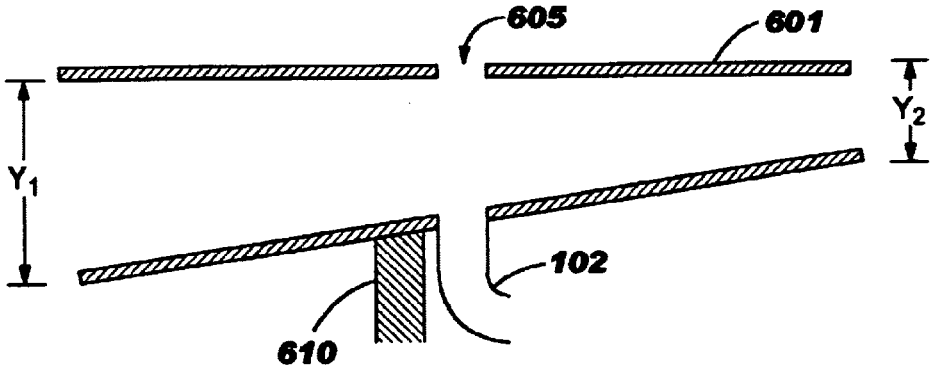
FIG. 8A is a detail cross-section view of a segment of the ring anode of FIG. 6.
Figure 8B:
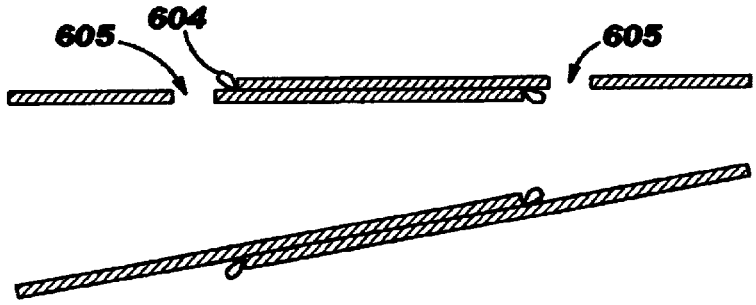
FIG. 8B is a cross-section view of two ring segments fitted together to form a portion of a small-diameter ring anode.
Figure 8C:
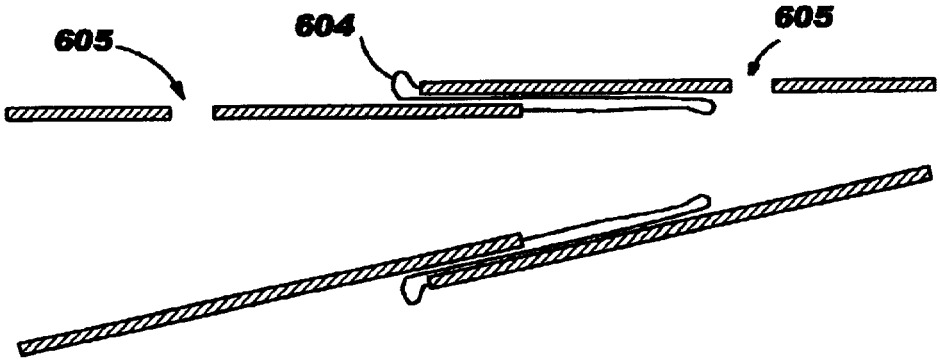
FIG. 8C is a cross-section view of two ring segments fitted together to form a portion of a large-diameter ring anode.

In another embodiment of the invention, the anode ring 100 comprises an array of interconnecting fluid-carrying segments 601, as shown in plan view in FIG. 6. Each segment 601 in plan view is an arc-shaped portion of the ring anode. Each segment 601 is tapered in the circumferential direction so as to have a narrow end and a wide end; in FIG. 6A, $X_1>X_2$. The narrow end of each segment inserts into the wide end of the adjacent segment. The size of the anode ring is determined by whether the segments overlap by a large amount (FIG. 7B, small ring) or a small amount (FIG. 7C, large ring). FIG. 8A shows one segment in cross-section; the profile is also tapered so that $Y_1>Y_2$. At least one segment has a fluid dispensing tube 102 attached to its underside, and may have a pin 610 for connection to a mechanical actuator. FIGS. 8B and 8C show two segments fitted together in a small-diameter and a large-diameter ring, respectively. A flexible plastic seal 604 connects the wide end each segment with the narrow end of the adjacent segment, as shown schematically in FIGS. 8B and 8C. The fluid escapes from each segment through a dispensing port 605. Accordingly, the top surface of the variable-diameter anode is covered with a supply of fluid which is constantly refreshed. Since in this embodiment all of the segments are mechanically linked, the size of the ring may be adjusted by forcing two segments at opposite sides of the ring (e.g. 601*a* and 601*b*) linearly toward each other or away from each other, using pins 610. As in the first embodiment, the anode current (and hence the metal deposition rate) may be varied as the radius of the anode ring is varied, so that the profile of plated metal across the wafer may be precisely tailored.

Other features may be added to the apparatus to extend its capabilities and to provide still greater process flexibility. For example, the tool may be equipped with a wafer heater or a dispenser for hot water (>80 ° C.) onto the wafer, to permit annealing of the plated copper. The tool may also have a separate annealing chamber for performing an additional anneal before the wafer is removed.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. An electroplating apparatus in which electroplating of a metal layer is performed on a substrate, the apparatus comprising:

a plurality of dispensing segments each having at least one hole for dispensing an electroplating solution onto the substrate, the dispensing segments forming a circular counterelectrode and being movable with respect to each other during an electroplating process so that the counterelectrode has a variable diameter, the electroplating solution thereby being dispensed on an annular portion of the substrate having a diameter corresponding to the diameter of the counterelectrode; and a carrier for holding the substrate substantially parallel to and rotating with respect the counterelectrode and including a plating electrode.

2. An apparatus according to claim 1, further comprising a plate parallel to the substrate, each dispensing segment being attached to the plate and slidable with respect thereto along a radius of the circular counterelectrode.

3. An apparatus according to claim 2, further comprising a flexible electrical conductor for electrically connecting the dispensing segments.

4. An apparatus according to claim 1, further comprising a plurality of flexible tubes for providing the electroplating solution to each of the dispensing segments.

5. An apparatus according to claim 1, wherein the counterelectrode is an anode, and the plating electrode is a cathode.

6. An apparatus according to claim 1, further comprising an anode electrode in contact with the electroplating solution.

7. An electroplating/electroetching apparatus in which at least one of an electroplating process and an electroetching process are performed on a substrate, the apparatus comprising:

a plurality of dispensing segments each having at least one hole for dispensing at least one of an electroplating solution and an electroetching solution onto the substrate, the dispensing segments forming a circular counterelectrode and being movable with respect to each other so that the counterelectrode has a variable diameter, the electroplating solution and electroetching solution thereby being is dispensed through the dispensing segments during the electroplating process and the electroetching process respectively on an annular portion of the substrate having a diameter corresponding to the diameter of the counterelectrode;

an anode electrode in contact with at least one of the electroplating solution and the electroetching solution; and a carrier for holding the substrate substantially parallel to and rotating with respect the counterelectrode and including an electrode for use in the electroplating process and the electroetching process.

8. An apparatus according to claim 7, wherein the electrode in said carrier is a cathode, and further comprising a voltage source connected to the cathode and to the anode electrode, whereby current is conducted between the cathode and the anode in a forward direction during an electroplating process and in a reverse direction during an electroetching process.

9. An apparatus according to claim 1, wherein each of the dispensing segments of the counterelectrode has a tapered profile in a direction along the circumference of the circular counterelectrode so that each segment has a narrow end and a wide end, the segments are arranged so that the narrow end of each segment is inserted into the wide end of the adjacent segment to form an overlap between adjacent segments, and the diameter of the circular counterelectrode is varied by varying an amount of overlap of adjacent segments.

10. An apparatus according to claim 1, further comprising a polishing table and a polishing pad disposed thereon, for performing a planarization process on the substrate.

11. An apparatus according to claim 10, wherein the polishing table is interposed between the substrate and the circular counterectrode after the electroplating process is performed.

12. An apparatus according to claim 10, further comprising a dispenser for dispensing non-abrasive slurry on the polishing pad, where the planarization process is chemical-mechanical polishing (CMP).

* * * * *